US005687554A

United States Patent [19]

Brown

[11] Patent Number: 5,687,554

[45] Date of Patent: Nov. 18, 1997

[54] ROLL STRAPPING APPARATUS

[76] Inventor: Ralph T. Brown, 712 Roaming Rd., Allen, Tex. 75002

[21] Appl. No.: 582,725

[22] Filed: Jan. 4, 1996

[51] Int. Cl.[6] ..... B65B 13/04

[52] U.S. Cl. ..... 53/589; 53/582

[58] Field of Search ..... 53/399, 589, 582; 100/4, 14, 25, 26

[56] References Cited

U.S. PATENT DOCUMENTS

| | | | |
|---|---|---|---|
| 2,818,795 | 1/1958 | Gustafson | 53/589 X |
| 3,291,037 | 12/1966 | Kunka et al. | 100/4 |
| 3,329,083 | 7/1967 | Bellmann | 100/3 |
| 4,944,139 | 7/1990 | Neilsen et al. | 53/599 |
| 5,211,350 | 5/1993 | Ritter et al. | 242/79 |
| 5,251,544 | 10/1993 | Abrams | 100/26 |

*Primary Examiner*—Linda Johnson
*Attorney, Agent, or Firm*—Akin, Gump, Strauss, Hauer & Feld, L.L.P.

[57] ABSTRACT

Apparatus for applying a flexible strap to an article, such as a roll of paper product, in a predetermined position with respect to a surface on the article, such as an end face of a roll, and in proper alignment with the end face to prevent loosening of the strap at a later time. A generally plate-like guide member has a strap guide surface thereon and a strapping head for feeding the strap around the guide surface for engagement with the article to be strapped. The guide member is mounted on linear bearings for translation with respect to a support frame. A spherical bearing is interposed between the linear bearing and the guide member to allow the guide member to be skewed with respect to the linear bearings to align itself with the end face or other surface on the article to be strapped. A series of pressure fluid piston and cylinder actuator positioning devices are mounted on the guide member and are engageable with the end face or other surface of the article to be strapped for proper positioning of the guide member and the strap for application to the article. The guide member is moved in opposite directions by two stage pressure fluid cylinder and piston actuators which may be actuated to center the guide member on the machine between two conveyors for the article, an upstream position and a downstream position for application of a strap to one or more ends of the article.

14 Claims, 4 Drawing Sheets

ROLL STRAPPING APPARATUS

FIELD OF THE INVENTION

The present invention pertains to a strapping apparatus for applying a flexible band or strap to an article in a predetermined position and, for example, in a plane substantially parallel to an end face or surface of a roll of flexible material, such as paper or cardboard, or similar articles which require precise placement of a flexible strap.

BACKGROUND

Various strapping operations which utilize flexible bands or straps for securing an article to itself or to another article require rather precise positioning of the strap on the article and, of course, in the position which will prevent loosening of the strap after application. One particularly troublesome strapping operation is with regard to large rolls of paper products, including cardboard, which are required to be wrapped or banded at a rather precise location with respect to the end face of the roll and in such a way that the band or strap will not become loose due to misalignment during the strapping operation. Other articles can require rather precise placement of a strap or band with respect to a surface on the article and in alignment with a particular axis or surface of the article.

Roll strapping apparatus have been developed for the above-mentioned application for strapping large rolls of paper products. In order to minimize misalignment or misplacement of the strap, apparatus has been developed with a floating support for a strap guideway or chute with the objective of providing for alignment of the strap in such a way that it will not become loose after application and with positioning of the strap at a desired position with respect to one or both ends of the roll or similar article. U.S. Pat. No. 3,291,037 to Kunka et al. describes a prior art roll strapping apparatus which includes a so-called floating frame for supporting the strap guideway. However, the guide member support frame of the Kunka et al. patent is not capable of alignment of the strap with the end face of the roll if the end face of the roll is skewed with respect to a plane normal to the direction of movement of the roll relative to the strapping apparatus.

Accordingly, continued improvements have been sought for accurate placement of a flexible strap or band around an article such as a roll of paper products and placement of the strap in such a way that the strap lies in a plane substantially normal to the axis of the roll so that the strap will not come loose after application to the roll. Other desiderata in the art of strapping apparatus have also been sought while developing the present invention and which will be apparent to those skilled in the art from reading the following summary, detailed description and claims.

SUMMARY OF THE INVENTION

The present invention provides an improved apparatus for applying a flexible strap or band to an article in a predetermined location on the article and while minimizing the chance that the strap or band will loosen after securement to the article.

In accordance with one aspect of the invention, a strapping apparatus is provided which is particularly adapted for applying flexible straps or bands to the ends of rolls of paper products wherein the strap is applied in a predetermined position with respect to the end face of the roll and in a plane which is substantially parallel to the end face and normal to the axis of the roll so that the strap will not loosen after application to the roll.

The strapping apparatus of the invention is provided with a unique strap guide and support member which is operable to be placed in a predetermined position accurately with respect to the article to be strapped or banded and the strap guide and support member is also mounted on a unique support structure which provides for aligning the guide and support member in a predetermined position, preferably substantially in a plane parallel to the end face and normal to the axis of a roll or other generally cylindrical article.

In accordance with another important aspect of the invention, a strapping apparatus is provided which includes a flexible strap guide member which is mounted on linear bearings and universal bearing means interconnecting the linear bearings with the strap guide member in a unique arrangement which allows the strap guide member to more precisely align itself in a predetermined plane with respect to a surface of an article to be strapped or banded.

Still further, the present invention provides a strapping apparatus having a unique arrangement of actuators which are operable to move the guide member in two opposite directions to precisely position the strap guide member in a predetermined position with respect to one or more surfaces on the article to be strapped.

The invention still further provides a unique strapping apparatus having a strap guide member which is adapted to be precisely positioned by a series of guide member positioning devices which provide for positioning the guide member in a predetermined position for applying a strap at one or both ends of an article, particularly a roll of paper product, for example.

In accordance with yet a further aspect of the present invention, a roll strapping apparatus is provided which is adapted for more precise application of a flexible strap or band to a roll of paper product or similar articles which is less complicated than prior art apparatus, is easy to construct and service, requires minimal technical training of operating personnel and is operable to apply bands or straps to various articles, including rolls of paper products, in an improved manner.

Those skilled in the art will appreciate the above-mentioned advantages and features of the invention together with other important aspects thereof upon reading the detailed description which follows in conjunction with the drawing.

DESCRIPTION OF A PREFERRED EMBODIMENT

Figure 1:
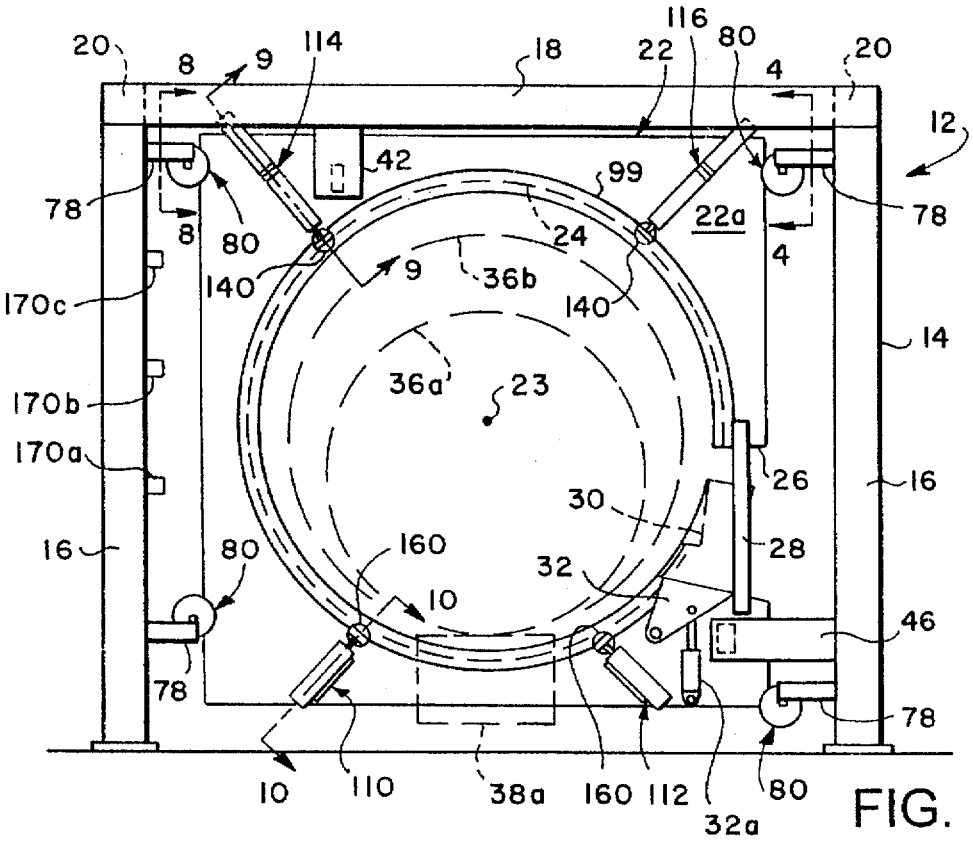
FIG. 1 is an elevation of one end of the improved strapping apparatus of the invention.

In the description which follows, like parts are marked throughout the specification and drawing with the same reference numerals, respectively. The drawing figures are not necessarily to scale and certain elements are shown in somewhat generalized or schematic form in the interest of clarity and conciseness.

Figure 2:
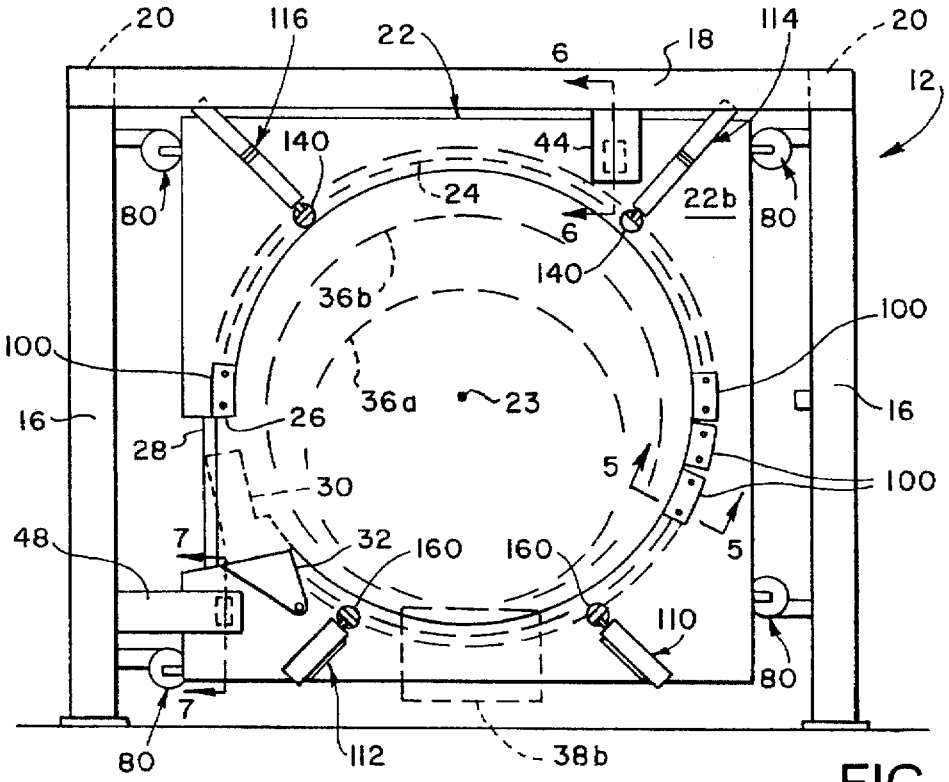
FIG. 2 is an elevation of the opposite end of the strapping apparatus of FIG. 1.
Figure 3:
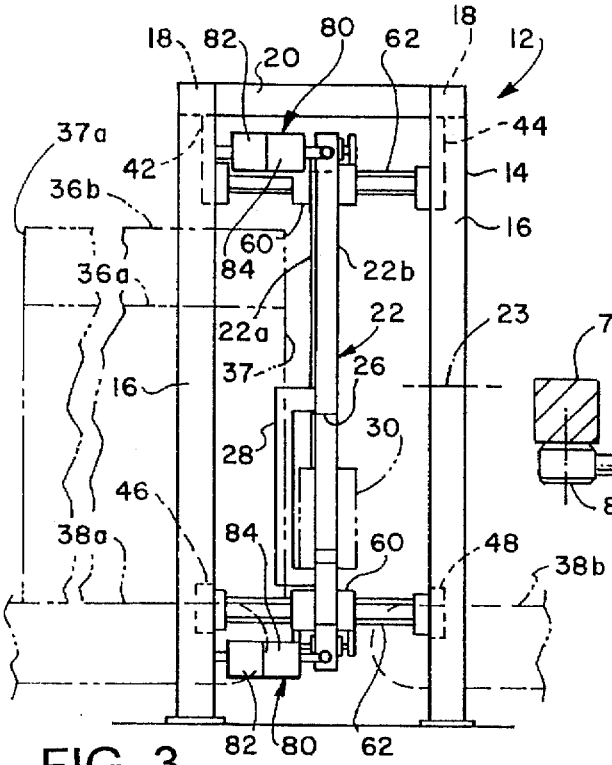
FIG. 3 is a side elevation of the apparatus shown in FIGS. 1 and 2.

Referring to FIGS. 1 through 3, there is illustrated an improved strapping apparatus in accordance with the invention and generally designated by the numeral 12. The apparatus 12 is characterized by a frame 14, preferably including four spaced apart upstanding column members 16, spaced apart pairs of which are interconnected by transverse beam members 18 and 20 as shown in FIGS. 1 through 3. The frame 14 is somewhat exemplary and may take other forms suitable for the apparatus of the invention. The column members and beam members may be formed of suitable structural metal shapes such as fabricated tubular box beam members, respectively, suitably interconnected such as by being bolted together or welded as preferred.

The frame 14 is adapted to support a unique strap guide member, generally designated by the numeral 22, which is preferably characterized as a large, generally rectangular steel plate having a suitable, generally circular opening formed therein and delimited by a strap guide surface 24. The plate 22 has opposed planar surfaces 22*a* and 22*b* which are substantially parallel to each other and are substantially flat. The surfaces 22*a* and 22*b* may achieve their flatness through a suitable machining or grinding operation or the like. Other metal forming operations may be utilized to obtain substantial flatness and parallelism of the surfaces 22*a* and 22*b*. The surfaces 22*a* and 22*b* are substantially normal to the central axis 23 of the circular guide surface 24. The strap guide surface 24 is interrupted at a gap 26 formed in the guide member 22, as shown in FIGS. 1 and 2, and a suitable support brace 28 bridges the gap 26 to maintain the plate 22 substantially rigid and planar. The brace 28 is somewhat U-shaped, see FIG. 3, to provide clearance for a power strapping apparatus, generally designated by the numeral 30, which is mounted on the strap guide member 22 at the gap 26, as shown. The apparatus 30 may be of a type commercially available such as a Model M20 Power Strapping Machine available from Signode Corporation, Glenview, Ill. The apparatus 30 is pivotally mounted on a suitable support member 32 on the guide member 22 for movement into and out of a predetermined position with respect to the guide surface 24 for feeding a flexible or elastically bendable metal or plastic strap around an article to be secured by such a strap, such as generally cylindrical rolls of paper products of different diameters, as indicated by numerals 36*a* and 36*b* in FIGS. 1 through 3. A pressure fluid operated actuator 32*a*, FIG. 1, is operable to move apparatus 30 to and from a working position. The articles to be strapped by the apparatus 12 may be positioned generally with respect to the frame 14 by conventional endless conveyor means 38*a* and 38*b*, see FIGS. 1 through 3. The conveyor means 38*a* and 38*b* are operable to position a roll article 36*a* or 36*b* within the opening defined by the guide surface 24 so that the article may have a strap applied thereto adjacent a first or forward end 37, see FIG. 3, and the article may also have a strap applied thereto adjacent its trailing end face 37*a*, both straps being at predetermined positions with respect to the opposed transverse end faces or surfaces 37 and 37*a* of the roll articles. For the sake of discussion further herein, the conveyors 38*a* and 38*b* are operable to traverse the articles 36*a* or 36*b* from left to right, viewing FIG. 3, as the articles progress through the apparatus 12 to have flexible bands or straps applied thereto.

Referring further to FIGS. 1 through 3, the frame 12 has spaced apart depending support members 42 and 44 which may, for example, be supported by the spaced apart beam members 18, respectively, as shown in FIGS. 1 and 2. Still further, the frame 12 includes transversely extending support members 46 and 48, see FIGS. 1 and 2, which are secured to respective ones of the column members 16, as shown.

Figure 6:
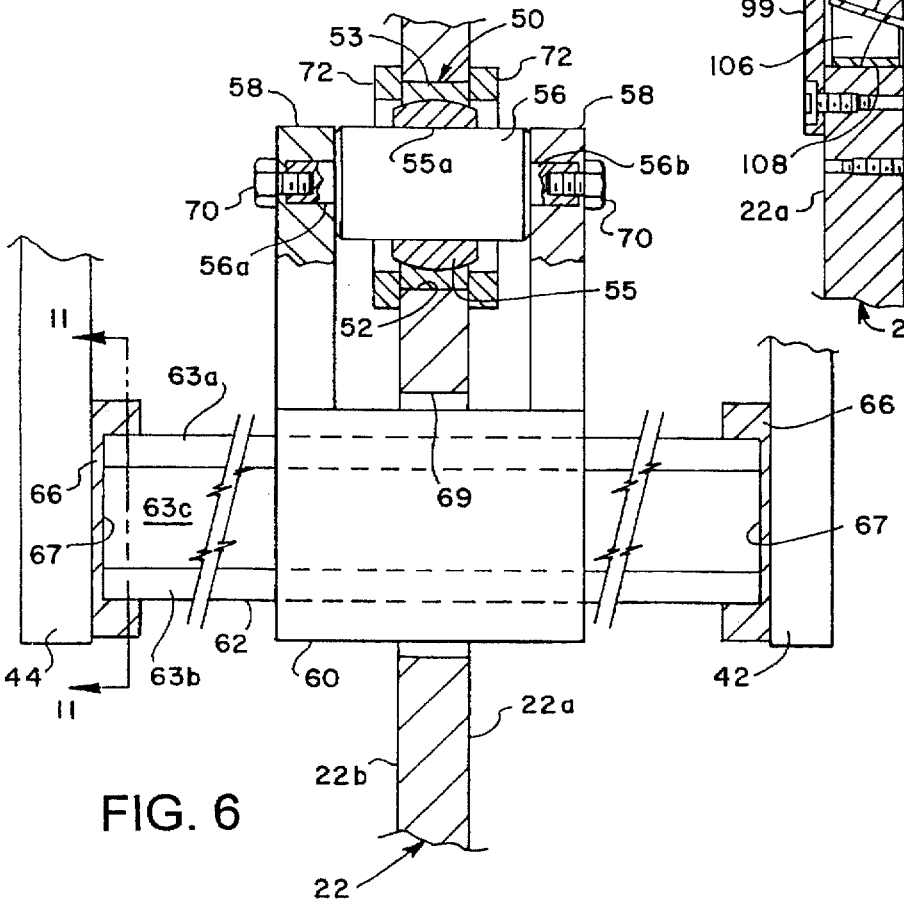
FIG. 6 is a section view taken from the line 6—6 of FIG. 2.
Figure 11:
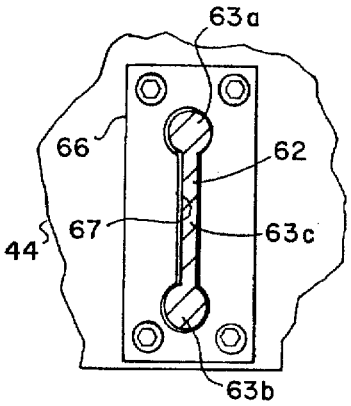
FIG. 11 is a detail section view taken from the line 11—11 of FIG. 6.

Referring to FIG. 6, one of two spaced apart support bearings for the guide member 22 is shown and includes a universal or spherical bearing assembly, generally designated by the numeral 50, disposed in a suitable bore 52 formed in the member 22. The bearing assembly 50 may be a spherical type B-L available from Roller Bearing Company of America, West Trenton, N.J., for example. The bearing assembly 50 includes an outer race 53 and an inner bearing member 55 supported therein and supporting an elongated cylindrical shaft 56. The shaft 56 is force fitted in bore 55*a* of bearing member 55 and is provided with opposed trunnion parts 56*a* and 56*b* which are connected to opposed upstanding bracket members 58, respectively. The bracket members 58 are suitably mounted on a linear bearing assembly, including a bearing housing 60 which is supported for linear sliding movement on a linear bearing member 62. The linear bearing assembly comprising the members 60 and 62 may also be of a type commercially available and may be a recirculating ball bushing-type bearing, such as a Type A available from Thompson Industries, Inc., Port Washington, N.Y. The member 60 is adapted to move effortlessly on the linear member 62 in either direction toward one or the other of the support members 42 and 44. The bearing member 62 is characterized by generally cylindrical parallel rod portions 63*a* and 63*b* and an interconnecting web 63*c*, see FIG. 11 also. The bearing member 62 is journaled in opposed support members 66, suitably secured to the respective frame members 42 and 44 and including socket portions 67 having essentially the same cross sectional shape as the member 62, see FIG. 11. However, the sockets 67 are dimensioned to be slightly larger than the dimensions delimiting the surfaces of the bearing member 62 so that the bearing member 62 may move laterally slightly with respect to the members 66.

Figure 7:
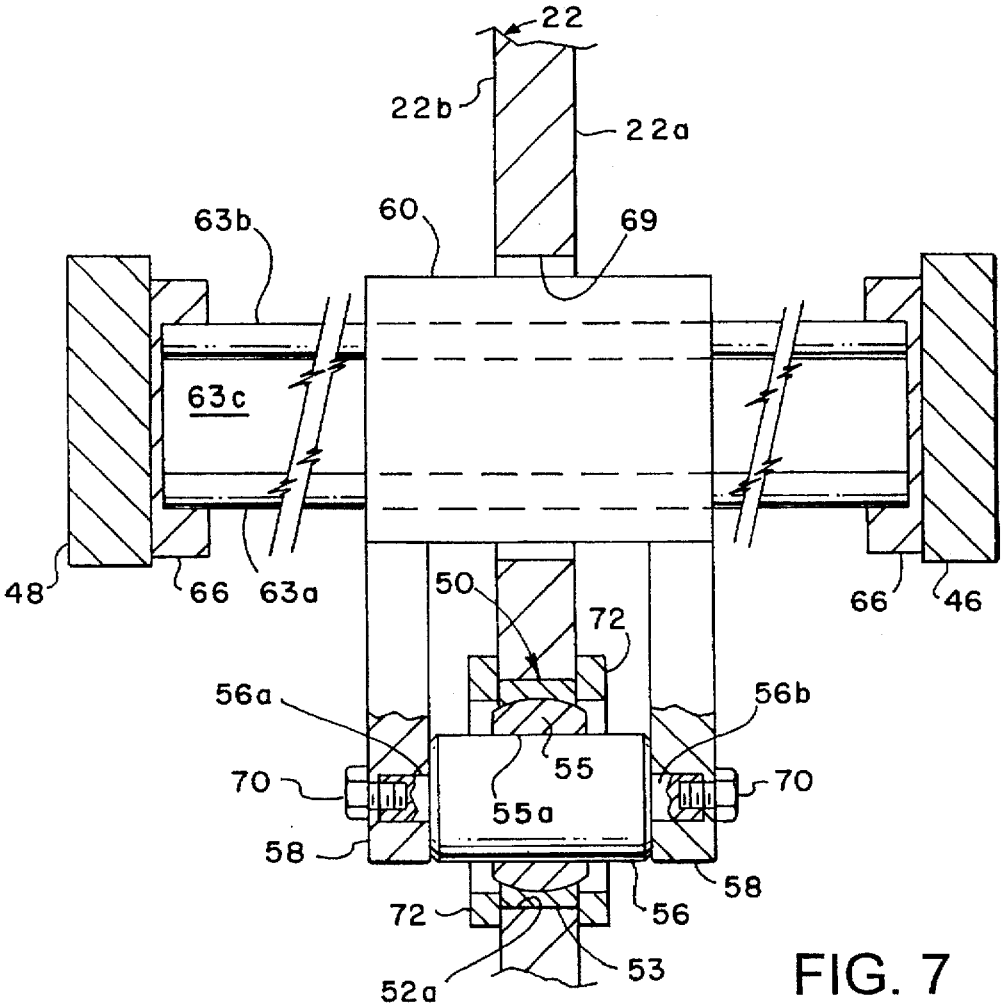
FIG. 7 is a section view taken from the line 7—7 of FIG. 2.

Referring briefly to FIG. 7, a second bearing assembly 60, 62, virtually identical to the bearing assembly just described in conjunction with FIG. 6, is operably connected to the guide member 22 at a point generally diagonally across the guide member, by way of a spherical bearing assembly 50 mounted in a bore 52*a* and is supported by the frame members 46 and 48. Depending on the weight of guide member 22, it may be preferable to arrange both linear bearing assemblies 60, 62 as shown in FIG. 6 to reduce tensile loads taken by the bracket members 58 and bearing members 60. As shown in FIGS. 6 and 7, the guide member 22 is provided with suitable recesses 69 to provide clearance for the linear bearing member 60 and to permit limited excursion of the guide member 22 with respect to the linear bearing members 60 and 62, and out of a plane normal to axis 23, thanks to the spherical bearing assemblies 50 which interconnect the guide member 22 with the linear bearing assemblies 60, 62. The strap guide member 22 is operable to undergo linear excursion toward and away from the conveyors 38*a* and 38*b*, respectively, to provide for positioning the guide member with respect to the end faces of an article such as a roll of paper product, 36*a* or 36*b*, for example. As shown in FIGS. 6 and 7, the shafts 56 are secured to the linear bearing brackets 58 by suitable fastener means such as hexhead bolts 70, for example, and the bearing assemblies 50 are retained in the bores 52 and 52*a* in the guide member 22 by suitable retainer rings 72 suitably secured to the guide member.

Referring again to FIGS. 1 and 2, the apparatus 12 includes means for moving the guide member 22 in opposite directions along the axis 23 to position it for applying a flexible strap or band to an article such as a roll of paper product 36*a* or 36*b*. As shown in FIG. 1, each of two of the opposed column members 16 include spaced apart laterally extending support brackets 78 which support one end of linear actuator assemblies 80, respectively. The opposite ends of the actuators 80 are secured to opposite sides of the guide member 22.

Figure 4:
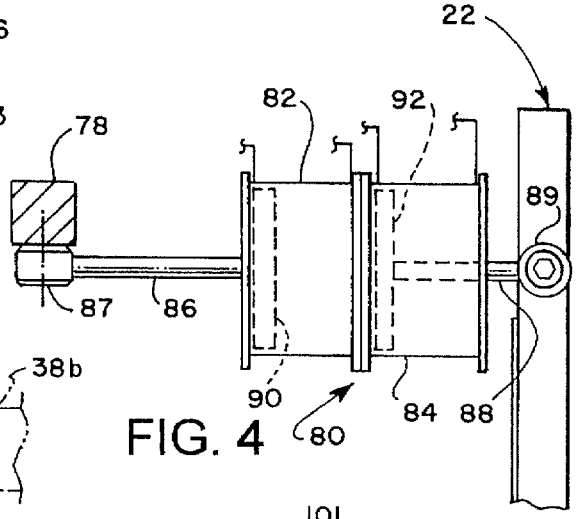
FIG. 4 is a view taken generally from the line 4—4 of FIG. 1.
Figure 8:
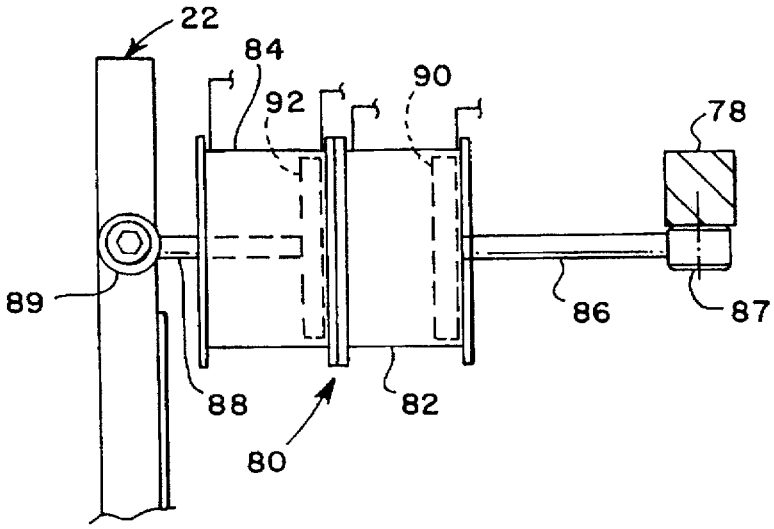
FIG. 8 is a detail view taken from the line 8—8 of FIG. 1.

Referring to FIGS. 4 and 8, two of the actuators 80 are shown in further detail. The other two actuators 80 are virtually identical to the ones illustrated in FIGS. 4 and 8 and are connected between their support brackets 78 and the guide member 22 in substantially the same manner. As shown in FIGS. 4 and 8, each of the actuators 80 includes a tandem pressure fluid piston and cylinder actuator assembly including two series or tandem connected cylinder members 82 and 84 connected end to end in such a way that opposed axially aligned piston rods 86 and 88 extend therefrom and are suitably connected to the brackets 78 and the guide member 22 by rod end members 87 and 89. The rod end members 87 and 89 include suitable spherical bearing means, not shown, for allowing some lateral or angular excursion of the piston rods 86 and 88 with respect to the support brackets 78 and the plate-like guide member 22 to minimize lateral stresses on the rods 86 and 88. The piston rods 86 and 88 are connected to respective pistons 90 and 92 disposed in the cylinders 82 and 84, respectively. Pressure fluid, such as compressed air, may be supplied to the cylinders 82 and 84 by suitable control means, not shown, to extend or retract the piston rods 86 and 88, respectively.

In the positions of the actuators 80 shown in FIGS. 4 and 8, piston rod 88 is retracted into the cylinder 84 and piston rod 86 is substantially extended from cylinder 82. This is the normal at rest position of the guide member 22 along its axis 23, substantially centered between the conveyors 38*a* and 38*b*, as shown in FIG. 3. If it is desired to move the guide member 22 toward the conveyor 38*b*, pressure fluid is supplied to the cylinders 82 and 84 of each actuator 80 in such a way that the pistons 90 are held in the positions shown in FIGS. 4 and 8 with the piston rods 86 extended from the cylinder while pressure fluid is supplied to cylinders 84 to cause pistons 92 and piston rods 88 to extend from the cylinders to move the plate-like guide member 22 toward the conveyor 38*b*. Alternatively, if it is desired to move the guide member 22 toward conveyor 38*a*, from the centered position between the conveyors shown in FIG. 3, pistons 92 are held in the positions shown in FIGS. 4 and 8 with the respective piston rods 88 retracted, and pistons 90 are caused to move under the urging of pressure fluid to retract piston rods 86 into cylinders 82 to effect linear translation of the guide member 22 along its axis 23 toward the conveyor 38*a*. Suitable pressure fluid control circuitry and valving, not shown, may be used to cause the actuators 80 to translate the guide member 22 in the manner described above.

Figure 5:
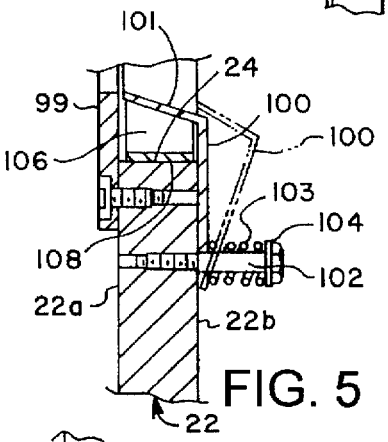
FIG. 5 is a detail section view taken from the line 5—5 of FIG. 2.

Referring now to FIGS. 1, 2 and 5, a strap guideway or chute is provided on the guide member 22 by the guide surface 24 and by an annular flange member 99, FIGS. 1 and 3, which forms a channel wall coextensive with surface 24 and secured to the side 22*a* of the guide member, see FIG. 5. As shown in FIGS. 2 and 5, the opposite side 22*b* of the guide member 22 is provided with a series of circumferentially spaced retractable channel forming guide plates 100 which are disposed essentially adjacent to each other around the circumferential extent of the guide surface 24 and are secured to the guide member 22 by spaced apart fasteners 102, see FIG. 5, and a coil biasing spring 103 interposed between the fastener head 104 of each fastener 102 and guide plate 100. Each guide plate 100 has a laterally extending flange portion 101 which, in the normal operating position shown by the solid lines in FIG. 5, forms an enclosed circumferential channel or chute 106 for guiding a flat, flexible strap or band 108 along the surface 24 as it is fed around the guide member 22 by the strapping apparatus 30. Once the strap 108 has been placed in the position shown in FIG. 5, apparatus 30 is actuated at a predetermined time to tighten and secure the strap around an article, such as the rolls 36*a* or 36*b*. The radial inward movement of the strap 108 will cause the guide plates 100 to deflect to the alternate position shown in FIG. 5 to clear the channel 106 and allow the strap to be secured to the article. The biasing springs 103 then return the guide plates 100 to their normal position for receiving the next strap to be fed along the surface 24 by the strapping apparatus 30.

An important advantage of the present invention is provided by a plurality of retractable guide member positioning devices which, together with the actuators 80, provide for aligning the guide member 22 with a surface of an article to be strapped by the apparatus so that the strap is not placed on the article out of a desired position or "out of square". Referring to FIGS. 1 and 2, the guide member 22 supports plural positioning devices on the opposed surfaces 22*a* and 22*b* wherein two, generally opposed positioning devices 110 and 112 are located, generally on the lower side of the guide member 22, on opposite sides thereof, as shown in FIGS. 1 and 2. The positioning devices 110 and 112 are essentially identical and are characterized as pressure fluid operated piston and cylinder type actuators. Two actuators or positioning devices 110 are located on the surfaces 22*a* and 22*b*, preferably directly opposite each other, and two positioning devices 112 are located on the surfaces 22*a* and 22*b*, also preferably directly opposite each other. Additional pressure fluid operating positioning devices 114 and 116 are mounted on the guide member 22 on the opposite sides or faces 22*a* and 22*b*, as shown in FIGS. 1 and 2. A positioning device 114 is mounted opposite another positioning device 114 on the respective faces 22*a* and 22*b* and a positioning device 116 is mounted opposite another positioning device 116 on the respective surfaces 22*a* and 22*b* as shown. The positioning devices 114 and 116 may be identical in construction. Each of the positioning devices 110, 112, 114 and 116 is operable to extend a positioning arm, described further herein, into the opening formed by the guide surface 24 to engage a surface of an article to be strapped such as an end face 37 of a roll off paper product 36*a* or 36*b*.

As shown in FIGS. 1 and 2, the positioning devices 110, 112, 114 and 116 are circumferentially spaced about a roll 36*a* or 36*b* on the guide member 22 in such a way that, when the positioning devices have been actuated to engage an end face or other suitable surface on an article to be strapped, the guide member 22 may be substantially linearly translated by the actuators 80 so that the positioning devices engage the article end face or surface and the guide member 22 is then caused to lie in a plane substantially parallel to the plane of the surface engaged by the positioning devices and, for example, normal to a central axis of an article such as a roll 36*a* or 36*b*. In this way, a strap may be properly aligned for attachment to the article in such a way that it will not eventually loosen. Moreover, the strap is also applied to the article in a predetermined position with respect to the end face or other surface which is engageable by the positioning devices 110, 112, 114 and 116.

Figure 9:
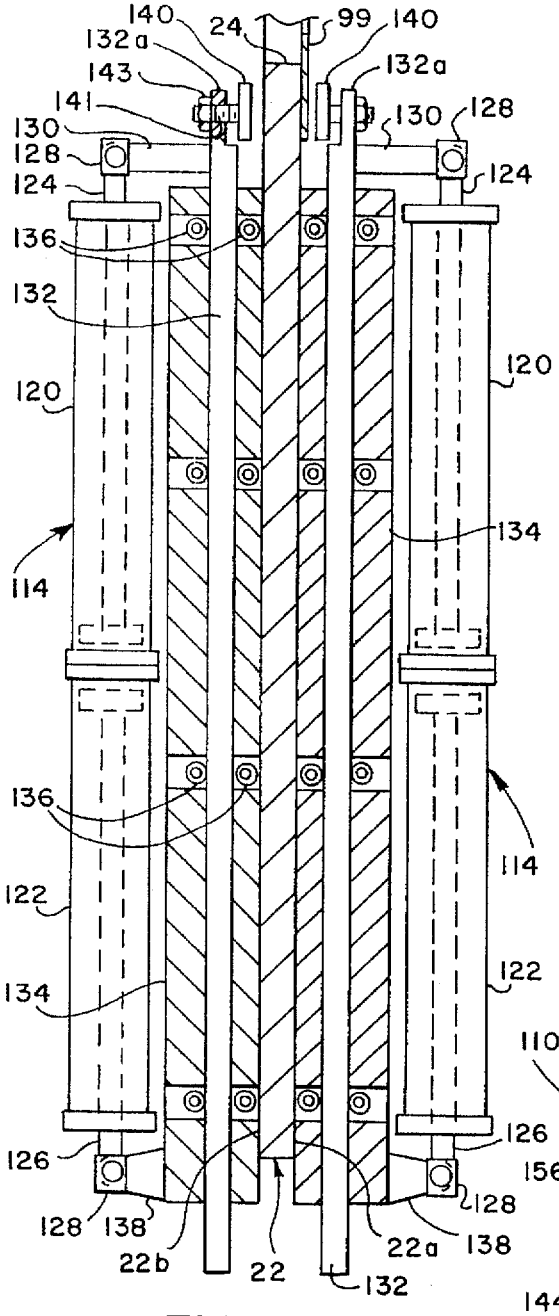
FIG. 9 is a section view taken from the line 9—9 of FIG. 1.

Referring now to FIG. 9, each of the positioning devices 114 is characterized by a pressure fluid piston and cylinder type actuator assembly including two opposed tandem oriented cylinders 120 and 122, each having a piston rod 124, 126 extending therefrom and having a suitable clevis member 128 attached to their distal ends, respectively. The clevis 128, attached to piston rod 124, is connected to a bracket 130 which, in turn, is connected to an elongated square or rectangular cross section arm 132 which is disposed in a support housing 134 for slidable movement on suitable bearing means comprising spaced apart pairs of bearing rollers 136, as shown. The clevis 128 connected to piston rod 126 is suitably connected to a clevis bracket 138 supported on the housing 134. The housing 134 is suitably mounted on the plate 22 by fastener means, not shown, and its position may be adjusted within limits longitudinally and laterally along the face 22*b*. One distal end 132*a* of each arm 132 supports a pad member 140 operable to engage a surface such as an end face 37 of a roll of paper product 36*a* or 36*b*, not shown in FIG. 9, when the associated positioning device 114 has extended the arm into the opening defined by the guide surface 24.

The positioning devices 114 and 116 mounted on the sides 22*a* and 22*b* are virtually identical in construction and are adapted to extend their respective positioning arms, such as the arms 132, into the opening defined by the guide surface 24 to an extent necessary to engage a surface such as an end face of a paper roll, depending on the size of the roll. For example, if the apparatus 12 detects the presence of a smaller diameter article, such as roll 36*a*, pressure fluid is supplied to both cylinders 120 and 122 to extend their piston rods 124 and 126 and thereby translate arm 132 farther into the opening defined by the surface 24 and toward axis 23. On the other hand, if the apparatus 12 detects the presence of a larger diameter article, such as the roll 36*b*, it may be necessary to extend the positioning devices only into the opening defined by the surface 24 sufficiently for the pads 140 to engage the article and thus only one of the actuators 120 or 122 need be energized with pressure fluid to extend its piston rod 124 or 126. Thanks to the clevis connections between the piston rods 124 and 126, and the arms 132, as well as the support housing 134, the actuators 120 and 122 are operable to extend and retract without binding their respective piston rods or the arms 132, thereby minimizing the chance of unwanted damage to the positioning devices 114.

Referring further to FIG. 9, the pads 140 may be adjusted as to their position with respect to the arms 132 and thus, the guide member 22. Each pad 140 has a threaded shank portion 141 which is threadedly engaged with a cooperating tapped hole in the distal end 132*a* of arm 132. A suitable lock nut 143 is threadedly connected to the shank 141 to secure the shank and the pad 140 in a suitable position, which may be adjusted to thereby adjust the position of the strap applied to an article with respect to the surface or end face that is engaged by the pad 140.

Figure 10:
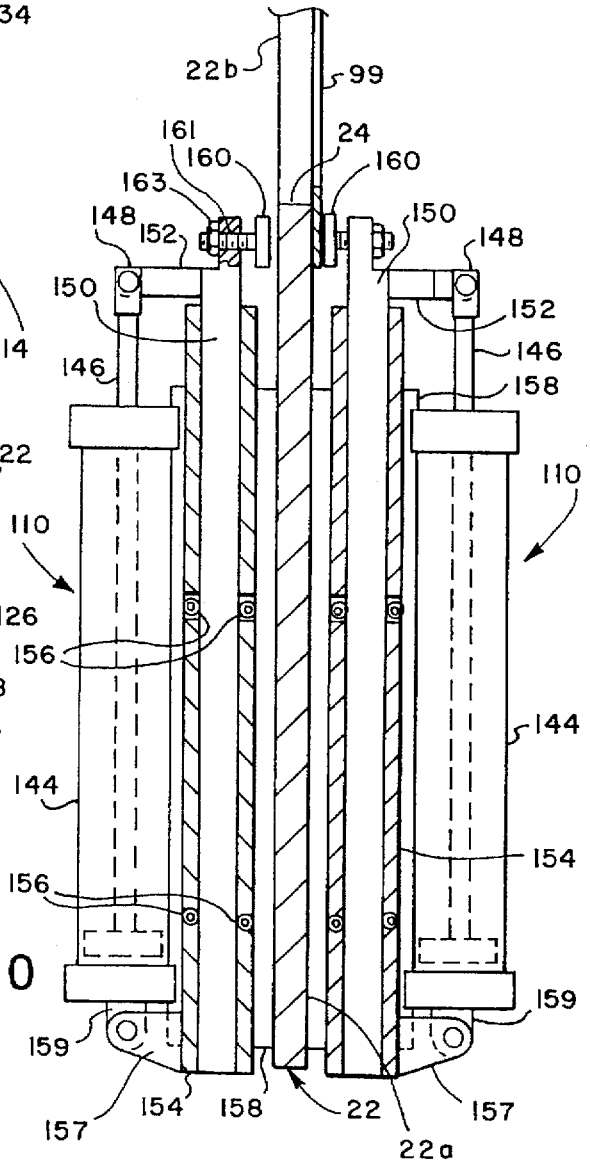
FIG. 10 is a section view taken from the line 10—10 of FIG. 1.

Referring now to FIG. 10, the positioning devices 110 are similarly constructed and are characterized by pressure fluid operated cylinder and piston type actuators 144, each having a piston rod 146 with a clevis 148 disposed on the distal end thereof and connected to an extensible square or rectangular cross section positioning arm 150 by way of a suitable bracket 152 interposed therebetween. Each positioning arm 150 is supported for linear translation on and within a support housing 154 by suitable spaced apart bearing means comprising rollers 156, as illustrated. Each support housing 154 is mounted on a support plate 158 and the support plates are suitably secured to the faces 22*a* and 22*b* of the guide member 22. The ends of cylinders 144 opposite the ends from which piston rods 146 project are provided with support means comprising clevis members 157 connected to brackets 159 on the cylinders for supporting the cylinders on housings 154. Each extensible arm 150 has a suitable pad 160 mounted on its distal end for engagement with a surface on the article to be strapped such as end face 37, FIG. 3, of a roll of paper product 36*a* or 36*b*. Each of the pads 160 is also supported on its support arm 150 by a threaded shank portion 161 threadedly engageable with a cooperating tapped hole in the support arm and locked in a preferred position by a lock nut 163. The positioning deices 114 and 116, mounted on side 22*b* of guide member 22, are extended to engage the leading or front end face 37 of an article 36*a* or 36*b* and the positioning devices 114 and 116 mounted on side 22*a* are extended to engage a trailing or opposite surface of an article in a manner to be described.

The two-stage arm extension arrangement of the actuators 114 and 116 is not required of the actuators 110 and 112 since the article to be strapped will always be of sufficient size to be engageable by the pads 160 once the arms 150 have been extended into the opening formed by the surface 24 because the positioning devices 110 and 112 are disposed along the lower edge of the opening in the guide member 22.

The apparatus 12 may be operated to apply one or more tensioned straps or bands about an article conveyed to and from the apparatus by the conveyors 38*a* and 38*b*. The apparatus 12 may be operated in a preferred sequence depending on which the direction the article moves as it traverses the conveyors 38*a* and 38*b*. For sake of discussion herein, it will be assumed, viewing FIGS. 1 through 3, that an article approaches the apparatus 12 on conveyor 38*a* and is brought to rest with one end of the article projecting into the space between the conveyors 38*a* and 38*b*. After one end of the article is operated on to apply a strap thereto it is moved from conveyor 38*a* to conveyor 38*b* and conveyor 38*b* is halted with the opposite end of the article disposed in the space between the conveyors. A band or strap is then applied to the opposite or trailing end of the article before it is moved away from the apparatus 12 on conveyor 38*b*. This sequence may be reversed if the direction of movement of the conveyors 38*a* and 38*b* is reversed.

As previously described, the actuators 80 normally are energized in such a way that the guide member 22 is positioned somewhat equidistant from the conveyors 38*a* and 38*b* therebetween. As the conveyor 38*a* moves an article into a position to be strapped, a suitable sensor associated with the conveyor drive motor, not shown, will deenergize the conveyor to allow the article to position itself with its leading end projecting beyond the end of the conveyor 38*a* and in close proximity to the guide member 22. As shown in FIG. 1, the apparatus 12 may be provided with suitable sensors 170*a*, 170*b* and 170*c* mounted on one of the column members 16 adjacent the conveyor 38*a* for detecting the presence of an article to be strapped and the size of the article. The sensors 170*a*, 170*b* and 170*c* may be of a photosensitive type, for example. Accordingly, if an article of sufficient size to be strapped approaches the apparatus 12 on conveyor 38*a*, its presence will be sensed by sensor 170*a*. If the article is of sufficient size to be engaged by the positioning devices 114 and 116, in their maximum extended position, this will be indicated by sensor 170*b*. Moreover, if the article to be strapped is of sufficient size to require that the positioning devices 114 and 116 extend only the minimum distances into the opening defined by surface 24, then this will be determined by sensor 170*c*. In other words, if all sensors 170*a*, 170*b* and 170*c* have produced a signal indicating the presence of an article, it is known that the article is a large diameter roll such as roll 36*b*, for example. If only sensors 170*a* and 170*b* indicate the presence of an article, then the positioning devices 114 and 116 are operated to extend their respective arms, such as the arms 132, the full distance by energizing both cylinders of the positioning devices.

When an article is detected at rest in proximity to the guide member 22, and is of sufficient size to be strapped by the apparatus 12, a suitable signal is provided to cause the actuators 80 to move guide member 22 to its first limit position, to the right viewing FIG. 3. Then, the positioning devices 110, 112, 114 and 116 mounted on surface 22*b* are actuated to be extended so that the pads 140 and 160 are in a position to engage the end face of the article or other suitable surface thereon. Actuation of the positioning devices 110, 112, 114 and 116 may be initiated by a timer device, not shown, which begins timing upon sensing the presence of an article to be strapped by the sensors 170*a*, 170*b* and 170*c*, or upon actuation of the actuators 80. The strapping apparatus 30 may also be energized at an appropriate time upon sensing an article to be strapped to extend a strap through the channel 106 and in engagement with the surface 24 in preparation for tightening the strap around the article.

Once the arms of the positioning devices 110, 112, 114 and 116 mounted on the surface 22*b* have been extended into the opening defined by the surface 24, the actuators 80 are energized to effect movement of the guide member 22 to the left, viewing FIG. 3, wherein the guide member will move until the pads 140 and 160 mounted on the ends of the positioning device arms engage the end face of the article, such as the end face 37 of a roll of paper product 36*a* or 36*b*. Thanks also to the mounting arrangement for the guide member 22, it will, upon engagement of its positioning devices with the end face of the article to be strapped, align the surface 24 so that a strap, such as the strap 108, will be disposed substantially in a plane parallel to the above-mentioned end face or, in the case of a roll, substantially normal to the central longitudinal axis of the roll, so that when the strap is applied to the roll, it will be "square" with the axis and will not tend to slip or become loose at a later time. As the arms of the positioning devices 110, 112, 114 and 116 engage the aforementioned predetermined surface or end face of the article to be strapped, the combination of the linear bearing assemblies 60, 62 and the spherical bearing assemblies 50 will permit appropriate movement of the guide member 22 into a position which will permit strapping of the article in such a way that the strap will not become loose. Moreover, the strap will also be applied to the article a predetermined distance from the aforementioned surface or end face.

Once the guide member 22 has been properly positioned, a signal from the aforementioned control means, which signal may be time dependent based on time zero being when the positioning devices or actuators 80 have been energized, will cause the strapping apparatus 30 to apply, tension and secure a strap to the article. Once the strapping apparatus 30 has completed its strapping and securing operation, a signal is initiated by the apparatus 30 to cause the actuators 80 to move the guide member 22 back to its original centered position or to the far right position, viewing FIG. 3, thereby relieving pressure on the arms of the positioning devices 110, 112, 114 and 116 mounted on surface 22*b*. The arms of positioning devices 110, 112, 114 and 116 mounted on surface 22*b* are then retracted and conveyors 38*a* and 38*b* are energized to move the article through the apparatus 12 until the trailing end of the article, or a suitable surface thereon, is positioned in predetermined proximity to the guide member 22, and disposed in the space between the conveyors 38*a* and 38*b*.

The actuators 80 are then energized to move the guide member 22 to the left, viewing FIG. 3, during traversal of the article from conveyor 38*a* to 38*b*, or shortly thereafter. After the article to be strapped is brought to rest with its opposite or trailing end in the space between conveyors 38*a* and 38*b*, and the guide member 22 is translated to its limit position to the left, viewing FIG. 3, the arms of the positioning devices 110, 112, 114 and 116 mounted on surface 22*a* are extended. When the positioning devices 110, 112, 114 and 116 mounted on surface or side 22*a* have been energized to extend their respective arms, the actuators 80 are again energized to bias the guide member 22 to the right, viewing FIG. 3, so that the surface engaging pads 140 and 160, for example, will engage the appropriate surface on the article such as the trailing end face 37*a* of a roll 36*a* or 36*b* of paper product. The guide member 22 will again be biased by actuators 80 into a position to lie in a plane generally parallel to the surface of the article engaged by the positioning devices 110, 112, 114 and 116 so that a strap may be applied properly aligned with and spaced from such surface. The strapping apparatus 30 is then again energized to apply a strap to the opposite end of the article. Once the strapping apparatus 30 has completed its operation, conveyor 38*b* may be energized to move the article away from the apparatus 12, the positioning devices 110, 112, 114 and 116 mounted on surface 22*a* are retracted and the actuators 80 are energized to center the guide member 22 between the conveyors 38*a* and 38*b* awaiting the next operating cycle. The positioning devices 110, 112, 114 and 116 may have appropriate sensors or limit switches associated therewith to prevent continuation of the aforementioned operating cycle if the article engaging arms of the respective positioning devices are not extended or retracted at the appropriate times in the steps of the operating cycle. Operation of the apparatus 12 may be carried out with a suitable control circuit for controlling operation of the conveyors 38*a* and 38*b*, and pressure fluid valving to effect operation of the actuators 80, the strapping apparatus 30 and the positioning devices 110, 112, 114 and 116. Moreover, the apparatus 12 may be constructed of conventional engineering materials used for industrial machinery, particularly article strapping and handling apparatus in industrial environments.

A preferred embodiment of a unique strapping apparatus has been described above in connection with drawing FIGS. 1 through 11. However, those skilled in the art, will recognize that various substitutions and modifications may be made to the apparatus 12 without departing from the scope and spirit of the invention as set forth in the appended claims.

What is claimed is:

1. Apparatus for applying a flexible strap in a predetermined position on an article, such as a roll of paper product, said apparatus comprising:

a frame;

a strap guide member mounted on said frame for substantially linear movement to a position for applying said strap to an article in a predetermined position on said article, said guide member including means for guiding and supporting said strap for application to said article;

bearing means for supporting said guide member on said frame, said bearing means including spaced apart linear bearing assemblies for moving said guide member in generally opposite directions in a linear path with respect to said frame, and a universal bearing disposed between each of said linear bearing assemblies and said guide member for allowing movement of said guide member with respect to said frame to align said guide member with a surface on said article to be strapped so that said strap is placed in a predetermined plane with respect to said surface; and actuator means for moving said guide member to a position for applying said strap in said predetermined position on said article.

2. The apparatus set forth in claim 1 wherein:

said actuator means comprises at least one pressure fluid piston and cylinder actuator for moving said guide member between a centered position and two opposed limit positions.

3. The apparatus set forth in claim 2 wherein:

said at least one pressure fluid piston and cylinder actuator includes back-to-back pressure fluid cylinders having opposed piston rods connected to said frame and to said guide member, respectively, said back-to-back pressure fluid cylinders being operable to move said guide member to a centered position and to two opposed limit positions, respectively.

4. Apparatus for applying a flexible strap in a predetermined position on an article, such as a roll of paper product, said apparatus comprising:

a frame;

a strap guide member mounted on said frame for substantially linear movement to selected positions for applying a strap to an article in a first predetermined position on said article and a second predetermined position on said article, said guide member including means for guiding and supporting a flexible strap for application to said article in said selected positions;

bearing means for supporting said guide member on said frame for substantial linear movement of said guide member in opposite directions with respect to said frame for applying a first strap to said article in a first predetermined position and for applying a second strap to said article in a second predetermined position; and actuator means for moving said guide member from an at rest position to a first position for applying said first strap to said first predetermined position on said article and then moving said guide member to a second position for applying said second strap in said second predetermined position on said article, said actuator means comprising plural tandem pressure fluid cylinder and piston actuators interconnecting said guide member with said frame and operable to move said guide member between said at rest position, said first position and said second position.

5. The apparatus set forth in claim 4 wherein:

said bearing means includes a linear bearing assembly for supporting said guide member for movement in generally opposite directions with respect to said frame and spherical bearing means interconnecting said linear bearing assembly with said guide member for permitting movement of said guide member with respect to said frame to align said guide member with at least one surface on said article.

6. Apparatus for applying a flexible strap in a predetermined position on an article, such as a roll of paper product, said apparatus comprising:

a frame;

a strap guide member comprising a plate having a substantially flat surface thereon and mounted on said frame for substantially linear movement to a position for applying said strap to an article in a predetermined position on said article, said guide member including means for guiding and supporting said strap for application to said article;

bearing means for supporting said guide member on said frame and for allowing movement of said guide member to a position to be aligned with a surface on said article to be strapped so that said strap is placed in a predetermined plane with respect to said surface;

actuator means for moving said guide member to a position for applying said strap in said predetermined position on said article; and plural guide member positioning devices supported on said substantially flat surface independent of each other for positioning said guide member to lie in a predetermined plane in relation to a surface on said article to be strapped, said positioning devices being spaced apart about a central axis of an opening formed in said plate for receiving said article in such a way that upon engagement of said positioning devices with said article said guide member is caused to lie in said predetermined plane substantially parallel to the plane of said surface on said article engaged by said positioning devices, in response to movement of said guide member by said actuator means.

7. The apparatus set forth in claim 6 wherein:

said positioning devices comprise cylinder and piston type actuators.

8. The apparatus set forth in claim 6 wherein:

said guide member includes opposed substantially flat surfaces thereon and said guide member includes positioning devices mounted on said opposed surfaces for engaging a first surface on said article and a second surface on said article, respectively, for positioning said guide member to apply a strap to said article at spaced apart points thereon.

9. The apparatus set forth in claim 6 wherein:

said positioning devices comprise linear extensible piston and cylinder type actuators, each of said actuators being connected to a linearly translatable support arm of said positioning device.

10. The apparatus set forth in claim 9 wherein:

said actuators of said positioning devices are mounted on said guide member by flexible connection means interconnecting said actuators with said support arms to minimize binding of said support arms during linear extension and retraction movements thereof.

11. The apparatus set forth in claim 10 wherein:

said connection means comprise clevis connections between said support arms and said linear actuator.

12. The apparatus set forth in claim 9 including:

an adjustable pad member mounted on said support arm and operably engageable with a surface on said article for positioning said guide member with respect to said surface on said article.

13. The apparatus set forth in claim 9 wherein:

at least one of said positioning devices comprises an actuator which may be linearly extensible to a selected one of plural positions of said support arm for engagement with a surface on an article dependent on the size of said article.

14. The apparatus set forth in claim 1 wherein:

said guide member comprises a generally flat plate having a surface thereon defining an opening in said plate for receiving said article for application of said strap and said guide member includes a strapping apparatus mounted thereon for application of said strap around said article disposed in said opening.

* * * * *